US005472320A

United States Patent [19]

Weisbrodt

[11] Patent Number: 5,472,320

[45] Date of Patent: Dec. 5, 1995

[54] DISPLACEMENT PISTON PUMP

[75] Inventor: Rainer Weisbrodt, Iivesheim, Germany

[73] Assignee: ProMinent Dosiertechnik GmbH, Heidelberg, Germany

[21] Appl. No.: 408,895

[22] Filed: Mar. 22, 1995

[30] Foreign Application Priority Data

Mar. 23, 1994 [DE] Germany ..... 44 09 994.0

[51] Int. Cl.[6] ..... F04B 7/06

[52] U.S. Cl. ..... 417/326; 417/500; 417/415; 74/57

[58] Field of Search ..... 417/498, 500, 417/415, 326; 92/57; 74/56, 57

[56] References Cited

U.S. PATENT DOCUMENTS

| | | | |
|---|---|---|---|
| 1,824,938 | 9/1931 | Voorhees | 74/57 |
| 1,867,504 | 7/1932 | Franklin | 74/57 |
| 2,477,755 | 8/1949 | Langfelder | 74/57 |
| 2,567,576 | 9/1951 | Palumbo | 74/56 |
| 2,579,642 | 12/1951 | Bachman | 77/57 |
| 3,168,872 | 2/1965 | Pinkerton | 103/157 |
| 3,486,455 | 12/1969 | Jemison | 103/38 |
| 3,538,646 | 11/1970 | Beal | 74/56 |
| 4,437,016 | 3/1984 | Nakaya et al. | 74/57 |
| 4,575,317 | 3/1986 | Lindner | 417/500 |
| 4,941,809 | 7/1990 | Pinkerton | 417/500 |
| 5,096,394 | 3/1992 | Gerlach et al. | 717/500 |
| 5,158,441 | 10/1992 | Aid | 417/500 |
| 5,246,354 | 9/1993 | Pardinas | 417/500 |

FOREIGN PATENT DOCUMENTS 0298140 1/1989 European Pat. Off. .

*Primary Examiner*—Richard A. Bertsch
*Assistant Examiner*—Peter G. Korytnyk
*Attorney, Agent, or Firm*—Darby & Darby

[57] ABSTRACT

A displacement piston pump has a drive shaft that is driven by a rotating motor. The pump includes a piston which is axially movable within a cylinder and is connected to a piston guide shaft. The drive shaft and the piston guide shaft are rotatably coupled to each other, but some axial movement is permitted between these two members. The drive shaft and the piston guide shaft are coaxially aligned with respect to each other. The piston guide shaft has a guide element connected thereto. The guide element is guided in a guide way. The piston stroke can be maintained with high precision. The piston guide shaft is rotatably and axially supported in a support housing. The support housing contains the guide way therein and a guide element is rigidly connected to the piston guide shaft.

18 Claims, 1 Drawing Sheet

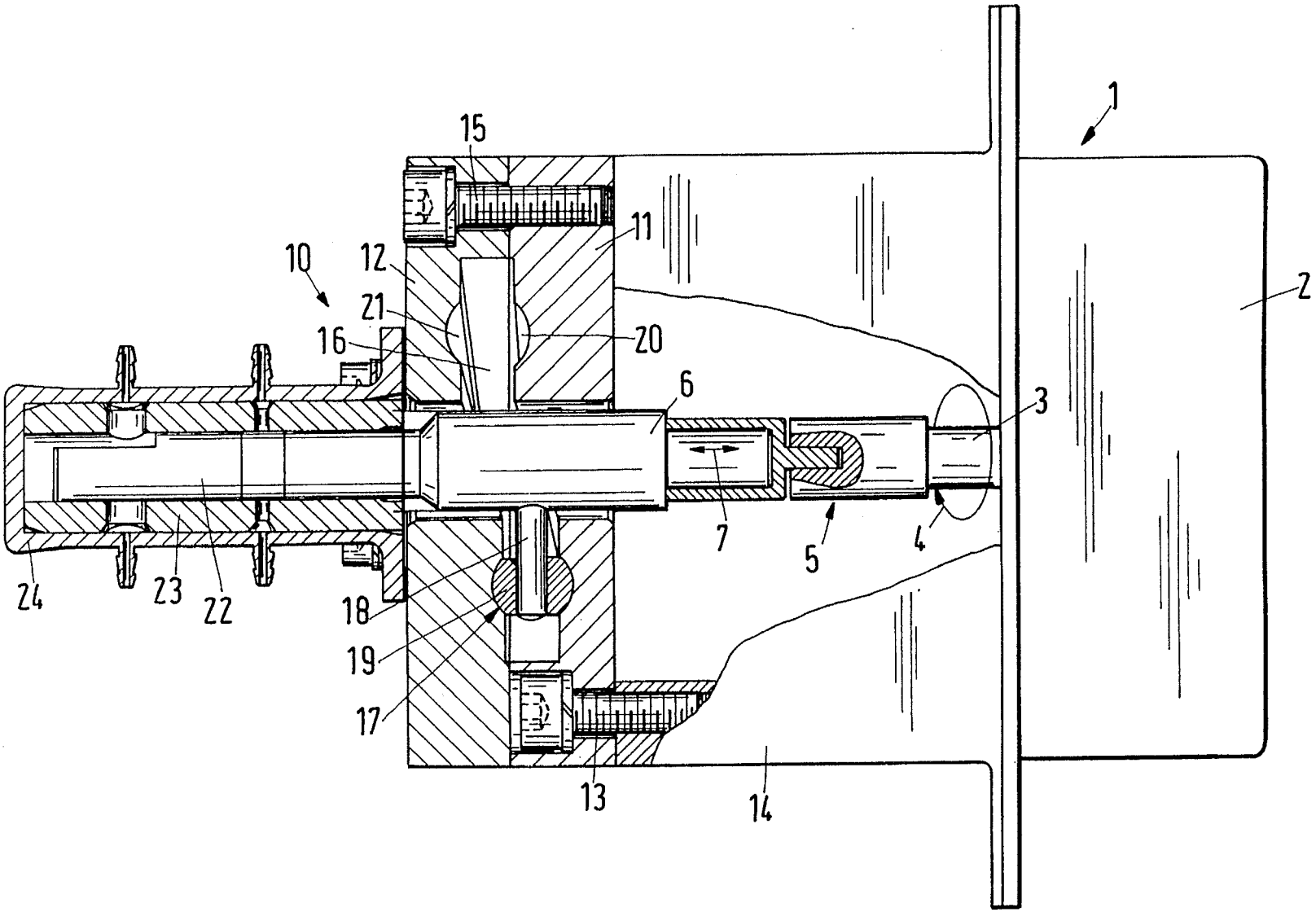
1
2
3
4
5
6
7
10
11
12
13
14
15
16
17
18
19
20
21
22
23
24

DISPLACEMENT PISTON PUMP

BACKGROUND OF THE INVENTION

1. Field of the Invention

The present invention relates to a positive displacement piston pump. More specifically, the present invention relates to a piston pump of the type having a drive shaft that is driven by a rotary motor and a piston which is axially movable within a cylinder and is connected with a piston guide shaft. The drive shaft and the piston guide shaft are rotatably coupled to each other and are axially movable with respect to each other. The drive shaft and the piston guide shaft are also coaxially aligned with respect to each other. The piston guide shaft is connected to a guide element, which is guided in a guide way.

2. Description of the Related Art

Positive displacement piston pumps, per se, are well known. For example, U.S. Pat. No. 3,168,872 describes a positive displacement piston pump where, in a first embodiment, the drive shaft and the piston guide shaft are disposed at an angle with respect to each other. A crank housing is provided on the drive shaft and includes a ball receptor with a ball being disposed therein. The ball forms an end of a crank which in turn is connected to the piston guide shaft. By changing the angle between the drive shaft and the piston guide shaft, a change in the length of the stroke of the piston can be obtained. In a second embodiment, the drive shaft and the piston guide shaft are aligned coaxially with respect to each other. A crank is provided on the piston guide shaft. A ball is provided at the end of the crank, and the ball is guided in a guide way which in turn is disposed in a pivotal housing. By pivoting the housing, the length of the stroke of the piston can be adjusted to vary the feed volume of the pump.

U.S. Pat. No. 5,158,441 describes another positive displacement piston pump in which the angle between the guide shaft and the piston guide shaft can vary. By changing the angle, the stroke length of the piston is changed. The drive connection of the piston drive shaft itself is achieved by a crank that is connected to the drive shaft and is guided by its head into a coupling. The coupling is connected with the piston drive shaft.

In both of the above examples of positive displacement piston pumps, it is difficult to precisely adjust the length of the stroke of the piston and, thus, the feed volume of the pump. Even in the applications where the angle between the drive shaft and the piston guide shaft is not adjustable, large tolerances prevail so that inaccuracies can only be minimized (i.e., not eliminated) with great difficulty by machining the individual parts with high precision.

SUMMARY OF THE INVENTION

Therefore, it is an object of the present invention to provide a positive displacement piston pump that has a simplified construction and can maintain an exact piston stroke length. This object is achieved by a preferred embodiment of the present invention where a positive displacement piston pump includes a piston guide shaft that is rotatably and axially supported within a support housing. A guide way is disposed within the support housing and a guide element is rigidly connected to the piston guide shaft.

In a preferred embodiment, a precise relationship between the piston guide shaft and the elements responsible for the reciprocal movement of the piston guide shaft (i.e., the drive system that converts the rotating movement of the drive shaft into the desired axial movement) is achieved. The length of the stroke is however, no longer adjustable, but an improved accuracy is achieved in setting the feed volume by simply adjusting the rotation speed of the piston. Additionally, in many applications, the varying of the feed volume is not a necessary feature, and particularly in the field of medicine, for example, in blood scrubbers during a dialysis, it is fully sufficient that the pump has a predetermined fixed feed volume. Because the housing support not only supports the piston guide shaft but simultaneously also forms the basis for the guide way, an exact arrangement of the individual housing and pump parts with respect to each other is possible with a minimum of effort. Basically, the only part that has to be machined accurately is the support housing.

The cylinder is preferably disposed in the support housing so that the piston guide shaft is supported, through the piston, to the support housing. In this manner, a predetermined spacial relationship exists between the cylinder and the guide way, which produces an improved accuracy when determining the feed volume. Because the piston guide shaft is supported by the piston in the cylinder, a correlation between the piston guide shaft, the cylinder and the guide way is achieved in a fairly simple manner. The more accurately this correlation can be maintained, the more accurately that the feed volume can be adjusted.

The guide element preferably protrudes radially and outwardly from the piston guide shaft. The guide element is rigid and is fixedly connected to the piston guide shaft. The guide element also preferably protrudes at a right angle with respect to the rotation axis of the piston guide shaft. Thus, the production of the guide element and piston guide shaft is simplified because there are no complicated angle orientations between the piston guide shaft and the guide element (i.e., a right angle can be produced relatively easily on most fabricating machines).

The guide element preferably has an enlarged section and the guide way surrounds this enlarged section so that in each angular position of the piston guide shaft, a contact point exists between the guide way and the enlarged portion. A tangent of this contact point extends normal to the piston guide shaft. Thus, independently of the rotative or angular position of the piston guide shaft, a power transmission always exists between the support housing and the guide element, which is directed exactly parallel to the rotation axis of the piston guide shaft. Further, an uneven application of power, no matter how small, will not lead to a change in the length of the piston stroke. Therefore, the accuracy of the feed volume can be maintained over extended periods of time.

The enlarged section preferably forms at least a part of a spherical surface or ball and the guide way is preferably foraged in the shape of a ball way. The guide way is thus formed as part of the outer surface of a torus, where the diameter of the cross-section of the torus matches the diameter of the ball. When the piston guide shaft undergoes one revolution, the ball slides in the guide way in a circumferential direction but also simultaneously pivots back and forth one time per each revolution. An even amount of friction is applied to the ball as well as to the guide way, thus minimizing the danger that localized abrasions will occur which could lead to a change in the piston stroke and correspondingly to the feed volume. It is therefore assured that the pump will maintain the same feed volume even as the pump is operated over long periods of time.

The enlarged section is preferably formed of a low friction material and cooperates with the material of the guide way.

The enlarged section is preferably made of a man-made material because these types of material will generally minimize abrasion. The selection of the guide element material will also permit the guide element to be more exactly fitted into the guide way. The more exact the fit, however, the higher the stress forces that are imposed on the guide element. Thus, a stronger drive moment is not necessary or is only necessary to a minimal extent because the friction characteristics are kept relatively low.

The support housing is axially divided into two housing parts, each of which parts includes a running surface of the guide way. The process of making the guide way is simplified because the same machinery settings can be used on each housing part, while still guaranteeing an exact stroke length. The running surface can be separately machined in each of the housing parts, because the axial side of each housing part (where they abut each other) is freely accessible from the sides. The assembly remains rather simple because the guide element can be placed between the two housing parts before they are connected together to form the complete housing.

It is also preferred that one of the housing parts (i.e., the first housing part) be connected to a motor or to an intermediate flange and that the other housing part be removably connected to the first housing part. This structural arrangement considerably improves the serviceability of the device. It may become necessary to inspect the guide way to determine if there are any abrasions on the guide element or the guide way. If necessary, parts of the guide element, for example the ball, can be replaced. Additionally, the other housing part can be removed without loosening the first housing part.

The support housing preferably has the shape of a cylinder and is connected to the other housing part. This simplifies the construction because a cylinder can be machined with the necessary precision rather easily.

The two housing parts are preferably fastened to each other in an area which is disposed radially outwardly of the cylindrical housing. Any service of the drive element area can then be performed without having to remove the cylinder from the corresponding housing part.

It is also preferred that both housing parts are identically formed at least with regard to the guide way. This measure again simplifies the machining, because when the guide way is machined, the tools for machining will have to adjusted only once for both housing parts to obtain a guide way that guides the guide element with the desired accuracy.

A motor having an adjustable speed of rotation is preferably used so that the feed volume can be varied. Thus, the fact that the piston stroke length can not be adjusted has no effect on the ability to vary the feed volume because the rotation speed of the motor is now used to control the feed volume.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

The single FIGURE shows a cross-section through the driving part of a positive displacement pump according to the present invention.

DETAILED DESCRIPTION OF THE PRESENTLY PREFERRED EXEMPLARY EMBODIMENTS

Referring now to the drawing FIGURE, a positive displacement pump 1, of which only the driving part is shown in cross-section, includes a motor 2 having a drive shaft 3 which rotates in the direction indicated by arrow 4.

Drive shaft 3 is connected with a piston guide shaft 6 by way of coupling 5. Coupling 5 transmits the rotation of the drive shaft 3 to the piston guide shaft 6, yet permits an axial movement of the piston guide shaft 6 relative to the drive shaft 3 in the direction indicated by double arrow 7. The piston guide shaft 6 is connected to a piston 22. Piston 22 is rotatably and axially moveable within cylinder 23. Cylinder 23 is fixedly disposed within a cylinder housing 24. Thus, piston guide shaft 6 is supported within the cylinder housing 24 by way of piston 22.

Because of the rotating movement of the piston guide shaft 6, which is transmitted to piston 22, a valveless control of the pump chamber is obtained as is known from, for example, U.S. Pat. No. 3,168,872, which has been discussed above, and the disclosure of which is hereby incorporated by reference. The reciprocal movement of the piston guide shaft in the direction of double arrow 7 is transmitted to the piston 22 as a piston stroke. Cylinder housing 24 forms a part of a support housing 10. Furthermore, the support housing 10 includes two housing parts 11 and 12. In this arrangement, housing part 11 is fastened to an intermediate flange 14 by way of screws 13. Flange 14 is fastened to motor 2. Housing part 12 is connected to housing part 11 by way of screws 15. After screws 15 have been loosened, housing part 12 can be axially removed or at least moved axially away from housing part 11.

A guide way 16, as part of the housing 10, is provided for the reception of a guide element 17. Guide element 17 includes a cylinder pin 18 that projects radially from the piston guide shaft 6 at one end and has at its other end a ball 19, which is preferably made of a man-made material, such as bronze or any other suitable material that has low friction properties and which cooperates with the material of the support housing 10.

Guide way 16 essentially has the shape of a torus. The torus axis is inclined by a predetermined angle with respect to the rotation axis of the piston guide shaft 6. This angle determines the extent of movement of the position guide shaft 6 in the direction of double arrow 7. In other words, the extent of movement of the piston stroke of piston 22 is determined by the angle of the guide way 16.

The torus, which forms the guide way 16, has an essentially circular cross-section. Each housing pan 11, 12 has a ring-shaped depression 20, 21. Each ring-shaped depression is, in its cross-section, limited by a part of a circular line.

At least with respect to the depressions 20 and 21, which each form a running surface for the ball 19, both housing pans are formed identically. Thus, the tool for machining the depressions 20 and 21 only has to be aligned once.

During each rotation of the piston guide shaft 6, the ball 19 is guided in the guide way in a circumferential direction. Because of the inclination of the guide way, which also could be designated as a "ball track", the ball is shifted in an axial direction. This axial shifting is transmitted to the piston guide shaft 6 by way of the cylinder pin 18. In this manner, the rotative movement, in the direction of arrow 4 is converted into a stroke movement in the direction of double arrow 7. Because of the support of the piston guide shaft 6 in the cylinder housing 24 (by way of piston 22) and thus in support housing 10, a definite structural relationship is maintained between the guide way 16 and the piston guide shaft 6 during its movement.

The guide way 16 with its depressions 20, 21 in the housing pans 11, 12 surrounds 19 so that at least one contact point is always present between ball 19 and housing pans 11, 12. A tangent at the point of contact is always vertical, as viewed in the drawing FIGURE, (i.e., is perpendicular) to the axis of the piston guide shaft 6. In other words, there is always a point present where only axial forces are impressed upon ball 19. An oblique positioning or a jamming of the ball is thus eliminated, which increases the reliability of the drive connection of the present invention to a great extent. Such a structural relationship between ball 19 and guide way 16 has the additional advantage that the ball 19 during its run in guide way 16, is not only moved in a circumferential direction but is also pivoted within guide way 16. The outer surface of the ball 19 and the surfaces of the depressions 20, 21 are abraded relative to each other not only in circumferential direction but also in a direction normal thereto at the same time. Thus, any chance that local abrasions will develop, such as a grooving of guide way 16 and ball 19, are drastically reduced.

To perform service on the displacement pump, housing 12 can simply be separated from housing part 11 after screws 15 have been loosened. Ball 19 and guide way 16 can now be inspected, and if necessary, ball 19 can be replaced. Additionally, because of the presence of coupling 5, it is possible to pull the piston guide shaft 6 out far enough to permit the removal and replacement of ball 19.

Motor 2 can have a variable speed of rotation. Accordingly, by changing the motor's speed of rotation, while having a constant stroke length, a change in the feed volume of pump 1 can be obtained.

Having described the presently preferred exemplary embodiment of a new and improved positive displacement piston pump, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What I claim is:

1. A positive displacement piston pump comprising:

a drive shaft being rotatably driven by a motor;

a support housing having a guide way formed therein, a cylinder being fixedly connected to said support housing; and a piston being movably arranged within said cylinder and connected to a piston guide shaft, said drive shaft and said piston guide shaft being rotatably coupled to each other, being axially movable with respect to each other, and being coaxially aligned with respect to each other, said piston guide shaft having a guide element connected thereto, said guide element being guided in said guide way, said piston guide shift being rotatably and axially movably supported within said support housing, said guide element being rigidly connected to said piston guide shaft.

2. A pump according to claim 1, wherein said cylinder is disposed within said support housing and said piston guide shaft is supported within said cylinder by way of a piston.

3. A pump according to claim 2, wherein said guide element projects radially outwardly from said piston guide shaft.

4. A pump according to claim 2, wherein said guide element includes an enlarged section that is surrounded by said guide way so that during each rotation of said piston guide shaft a contact point exists between said enlarged section and said guide way, said contact point having a tangent that extends normal to a rotating axis of said piston guide shaft.

5. A pump according to claim 4, wherein said enlarged section is formed at least partially spherically and said guide way is formed as a ball track.

6. A pump according to claim 5, wherein said enlarged section is formed of a low friction, man-made material that cooperates with the material of said guide way.

7. A pump according to claim 1, wherein said guide element projects radially outwardly from said piston guide shaft.

8. A pump according to claim 1, wherein said guide element includes an enlarged section that is surrounded by said guide way so that during each rotation of said piston guide shaft a contact point exists between said enlarged section and said guide way, said contact point having a tangent that extends normal to a rotating axis of said piston guide shaft.

9. A pump according to claim 8, wherein said enlarged section is formed at least partially spherically and said guide is formed as a ball track.

10. A pump according to claim 9, wherein said enlarged section is formed of a low friction, man-made material that cooperates with the material of said guide way.

11. A pump according to claim 1, wherein said support housing comprises two housing parts, each housing part comprising a running surface of said guide way.

12. A pump according to claim 11, wherein one of said housing parts is fastened to one of a motor and an intermediate flange and the other of said housing parts is removably fastened to said one of said housing parts.

13. A pump according to claim 12, wherein said support housing includes a cylinder housing which is fastened to said other of said housing parts.

14. A pump according to claim 13, wherein said two housing parts are connected together in an area which is disposed radially outwardly from said cylinder housing.

15. A pump according to claim 12, wherein said housing parts are formed, at least with respect to said guide way, symmetrically with respect to each other.

16. A pump according to claim 1, further comprising a motor having means for varying its speed of rotation, said motor being rotatably connected to said piston guide.

17. A pump according to claim 1, wherein said guide way is disposed at a predetermined angle with respect to a rotation axis of said piston guide shaft.

18. A pump according to claim 17, wherein said predetermined angle is less than 90°.

* * * * *